US008302879B2

(12) United States Patent
Christ et al.

(10) Patent No.: US 8,302,879 B2
(45) Date of Patent: Nov. 6, 2012

(54) RAIL EXPANSION DEVICE

(75) Inventors: Thomas Christ, Muhlhausen (DE); Tomas Bergk, Gotha (DE)

(73) Assignees: Voestalpine BWG GmbH & Co. KG, Butzbach (DE); VAE GmbH, Vienna (AT)

( * ) Notice: Subject to any disclaimer, the term of this patent is extended or adjusted under 35 U.S.C. 154(b) by 123 days.

(21) Appl. No.: 12/676,031

(22) PCT Filed: Sep. 3, 2008

(86) PCT No.: PCT/EP2008/061617

§ 371 (c)(1),
(2), (4) Date: Mar. 2, 2010

(87) PCT Pub. No.: WO2009/033993

PCT Pub. Date: Mar. 19, 2009

(65) Prior Publication Data

US 2010/0193597 A1 Aug. 5, 2010

(30) Foreign Application Priority Data

Sep. 12, 2007 (DE) ..... 10 2007 043 325

(51) Int. Cl.
*E01B 11/00* (2006.01)

(52) U.S. Cl. ..... 238/171

(58) Field of Classification Search ..... 238/165, 238/167, 171
See application file for complete search history.

(56) References Cited

U.S. PATENT DOCUMENTS

| | | | | |
|---|---|---|---|---|
| 4,785,994 | A * | 11/1988 | Crone et al. | 238/171 |
| 5,451,018 | A | 9/1995 | Heinze et al. | |
| 5,577,691 | A * | 11/1996 | Erich et al. | 246/437 |
| 5,590,833 | A * | 1/1997 | Benenowski et al. | 238/171 |
| 7,185,860 | B2 * | 3/2007 | O'Brien et al. | 246/442 |
| 2004/0113023 | A1 * | 6/2004 | Benenowski et al. | 246/435 R |

FOREIGN PATENT DOCUMENTS

| | | |
|---|---|---|
| DE | 4438127 | 5/1996 |
| DE | 19507376 | 9/1996 |
| DE | 10114683 | 10/2002 |

* cited by examiner

*Primary Examiner* — S. Joseph Morano
*Assistant Examiner* — Zachary Kuhfuss
(74) *Attorney, Agent, or Firm* — Dennison, Schultz & MacDonald

(57) ABSTRACT

Rail expansion device having stock and tongue rails which can be displaced longitudinally with respect to one another and bear against one another transversely with respect to the longitudinal direction of the rails under the application of force, wherein a holder releasably holds the tongue rail at a distance from the region thereof which bears against the stock rail, and wherein the tongue rail in the holder is non-positively and positively connected to a standard rail passing into it or to a section thereof or to a section of the holder having a profile which merges with that of the standard rail.

18 Claims, 5 Drawing Sheets

Section D-D

RAIL EXPANSION DEVICE

BACKGROUND OF THE INVENTION

The invention relates to a rail expansion device comprising a stock rail and a tongue rail, which can be shifted longitudinally relative to each other and are in contact under the application of force acting transversely relative to the rail longitudinal direction.

Rail expansion devices—also known as expansion joints—are installed for example in the area of bridges in order to allow relative movements between edifice and track. For this purpose, the tongue rail is arranged moveable relative to the stock rail. For this purpose, the tongue rail, for example, can be immobilized between the stock rail and a fixed clamping jaw on the opposite side. As explained in for example DE-A-1 534 052, tongue rail foot and stock rail foot originate from a common baseplate.

In a rail expansion device according to WO-A-93/23624 a stock rail is arranged moveable relative to a tongue rail, whereby the tongue rail is machined to match the curvature of the stock rail.

An expansion joint for grooved rails according to DE-A-195 25 135 features a section of track welded to a guide plate, whereby the guide plate is arranged on a sliding element displaceable along the longitudinal direction of the expansion joint.

In rail expansion devices known in the art, the tongue rails are usually welded to the adjoining control rail. Expensive work has to be performed if replacement of the tongue rail is made necessary by its state of wear. Moreover, not all materials can be welded together, resulting in the disadvantage that hard-to-weld, long-wearing steel types are not used.

SUMMARY OF THE INVENTION

It is the objective of the present invention to further develop a rail expansion device of the above type in a way that allows quick replacement of the tongue rail and allows materials to be used for the tongue rail that are non-weldable or consist of hard-to-weld, long-wearing steel types.

In order to meet this objective, the invention intends that the tongue rail be accommodated detachably in a holding device—some distance away from the region of the tongue rail located adjacent to the stock rail—and that in the holding device the tongue rail be form-fittingly and force-fittingly connected to a control rail, or a section of a control rail, or a section of the holding device merging into the control rail.

Different from rail expansions known in the art, the tongue rail is immobilized by means of a separate holding device, in which the tongue rail is connected to the control rail directly or indirectly in a positive or non-positive manner. The holding device itself may merge directly into a section of the control rail, so that the separable connection is established to a section of the holding device and a remaining section of the control rail.

Thus, the employed design is similar to that known from switches for grooved rails, as is described in EP-B-0 603 883 or DE-A-101 14 683, for example.

While the holding devices known in the art are solely intended for switch structures in the form of switches for grooved rails, the invention proposes a rail expansion device with a tongue rail with a profile that can correspond to that of a Vignoles rail.

However, the invention's teaching is also applicable to expansion joints for tracks of grooved rails. In such a case it is intended that the stock rail be arranged movable relative to the tongue rail, whereby the tongue rail rests upon a support, which in turn acts as the inner guide as a first guide for the stock rail. On the outer side the stock rail is at least in sections in contact to an outer guide as a second guide. In this, the second guide is connected, e.g. welded, to a baseplate, from which originates a side rail, which in turn is connected, in particular also by welding, to the guide preferably by means of a guide rail. To ensure a secure attachment, the guide rail should engage—with its longitudinal edge region on the side facing away from the stock rail—into a geometrically matching longitudinal recess of the side rail.

To prevent a horizontal movement of the tongue rail, spacer elements such as strips, which in particular are bolted to the guide rail, may be placed between the lateral face of the tongue rail facing away from the stock rail and the inner face of the side rail. Vertical movement of the tongue rail can be prevented if the tongue rail undercuts the stock rail in the head region.

The invention's teaching allows a simple mechanical structure particularly for expansion devices for grooved rails that due to the exchangeability of the tongue rail is embodied in a very easy-to-service manner. This in particular allows the option of manufacturing the tongue rail from a hardwearing and non-weldable or hard-to-weld material. This ensures a secure guideway for the stock rail, whereby the inner guide serves a double function in that it not only secures the stock rail against horizontal movement but at the same time provides support for the tongue rail.

The guide rail can additionally be supported by supports such as plate elements originating from the baseplate, so that bending in the vertical direction can be ruled out even under high load.

The holding device should be embodied with a block-like shape and in particular possesses two channel-like recesses extending along the rail's longitudinal direction, whereby into one recess are introduced the tongue rail with its heel as well as one wedge element, which is used to immobilize the tongue rail, i.e. to form-fittingly and force-fittingly connect the tongue rail to the adjacent stock rail or a section of the latter. The wedge element subsequently is secured in sections by fastening elements, such as bolts, extending within the second channel-like recess.

In order to replace the tongue rail it is now only necessary to detach the spacer elements or strips that are preferably bolted to the guide rail. Subsequently the wedge elements are removed so that the tongue rail can be removed and can be replaced by a new one. On the other hand, no work is required on the stock rail or its outer guide.

If parts of the holding device for the tongue rail heel are contained in a housing, the corresponding coverings are to be removed in order to be able to loosen and remove the wedge elements and thus the tongue rail.

Independent hereof, the tongue rail should consist of highly wear-resistant steel, such as BAINIT, hard manganese steel, tempered rail steel (R 350 HT grade), or tempered close-grained structural steel, e.g. DILIDUR, HARDOX, XAR in grades 400 to 500.

BRIEF DESCRIPTION OF THE DRAWINGS

Further details, advantages, and features of the invention are found not only in the claims and the characteristic features contained therein—individually and/or in combination—but also in the following description of a preferred embodiment example illustrated in the figures.

DESCRIPTION OF THE PREFERRED EMBODIMENTS

The figures purely schematically illustrate a rail expansion device 10 relating to grooved rails, but this is not to be interpreted as a limitation of the teaching according to the invention. On the contrary, the invention's teaching is also applicable for other rail profiles, in particular Vignoles rail.

Figure 3:
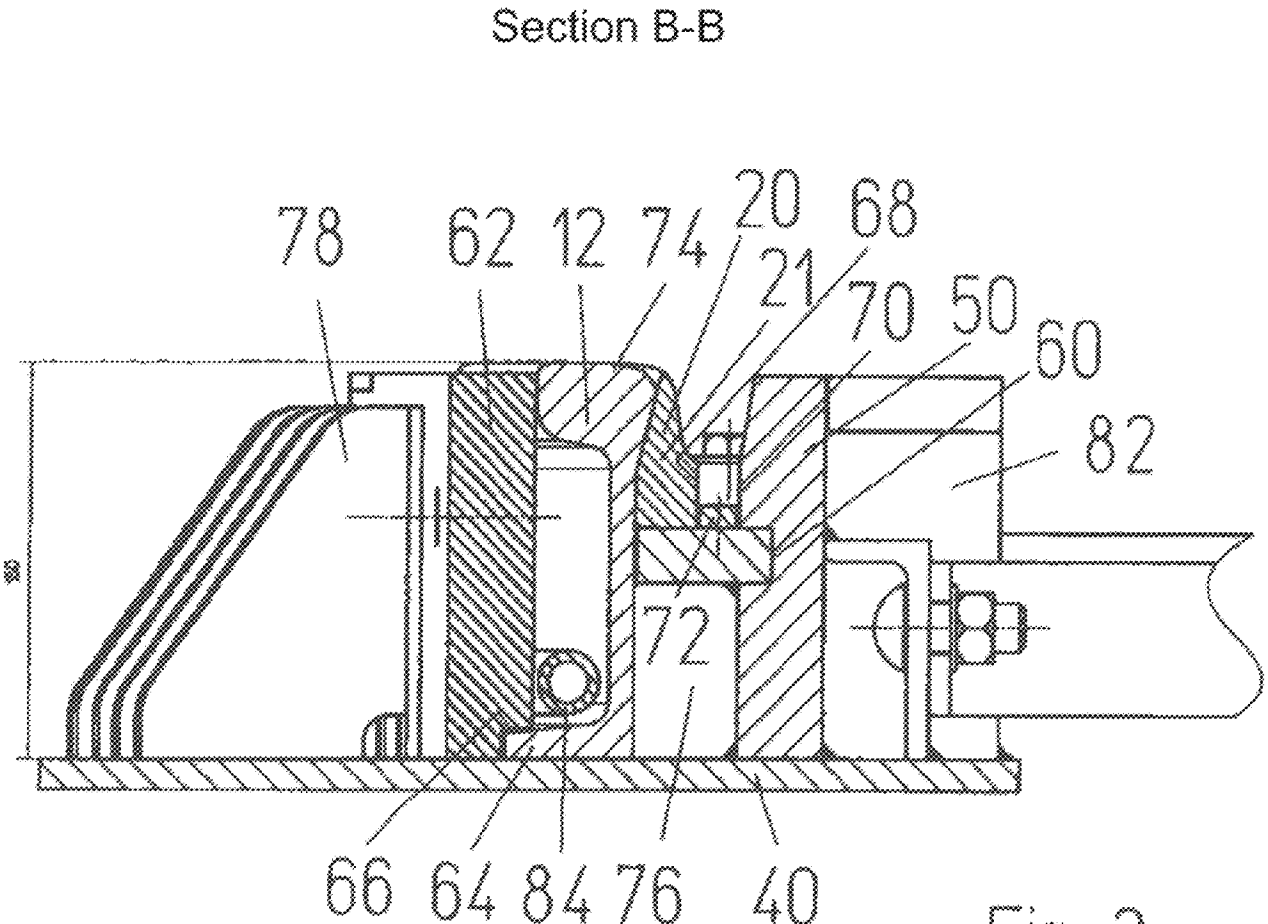
FIG. 3 shows a sectional view along the line B-B in FIG. 1.
Figure 4:
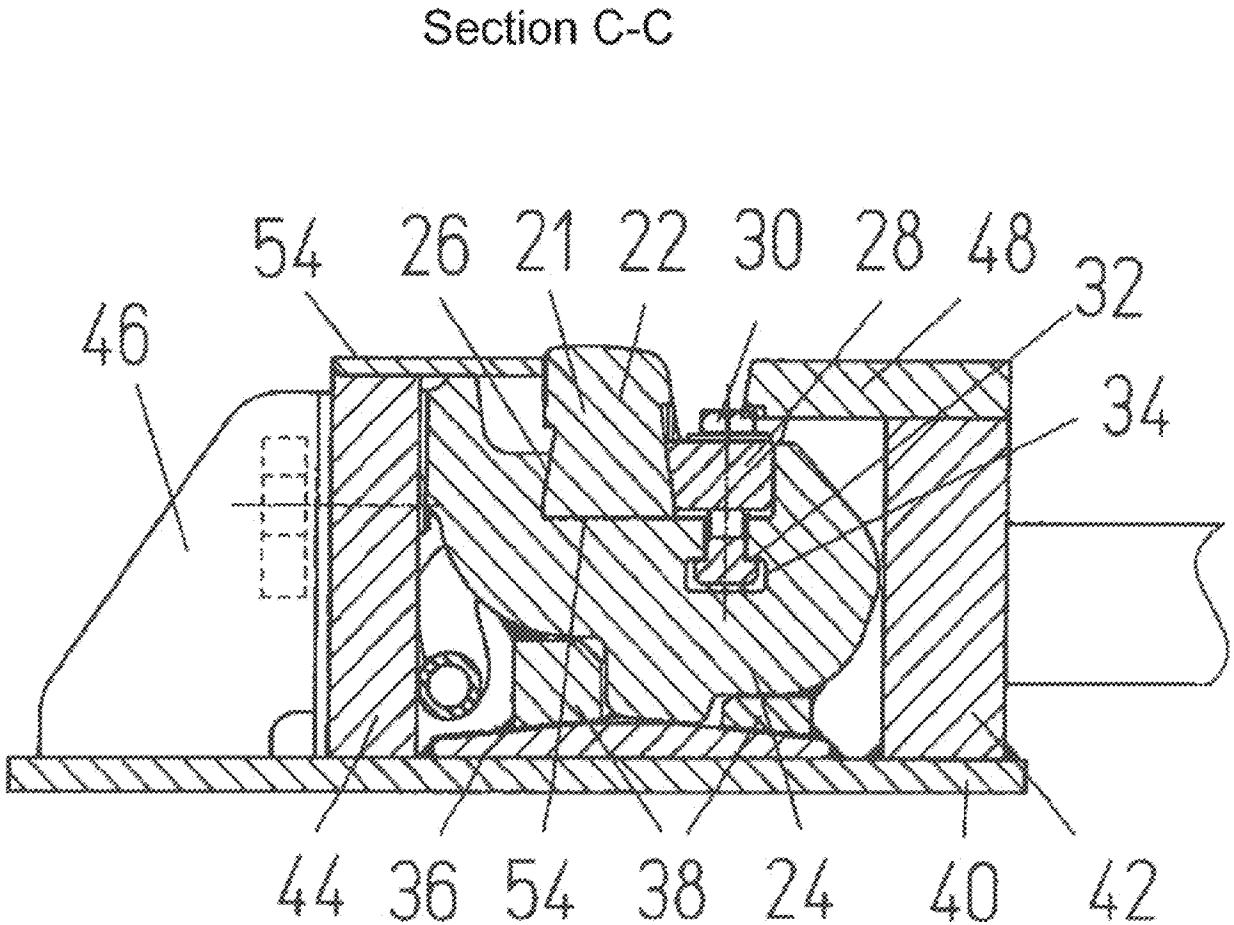
FIG. 4 shows a sectional view along the line C-C in FIG. 1.

The rail expansion device 10 in the usual manner comprises stock rails 12, 14, which are longitudinally moveable relative to tongue rails 21, which merge into control rails 16, 18, and of which a tip region 20 and a heel region 22 are illustrated in sectional views in FIGS. 3 and 4. In order to allow a relative movement between the stock rails 12, 14 and the tongue rails 21 merging into the control rails 16, 18—in dependence on the ambient temperature—the stock rails 12, 14 are directed outwards away from the tongue rails 21, so that a continuous transition from the tongue rails 21 or their tips 20 onto the stock rails 12, 14 can be ensured regardless of the effective length of the stock rails 12, 14.

The control rails 16, 18 consist of rail steel. Since the tongue rails 21 are subject to particularly high wear, they may in accordance to the invention's teaching consist of hard-to-weld or non-weldable materials, in particular high-tensile steel, since the tongue rails 21 merge into the control rails 16, 18 in a positive and non-positive manner without any welding joints. For this purpose are provided so-called tongue adapters, which are to be referred to as holding devices 24 and via which the tongue rails via their heel regions 22 merge flush directly or indirectly into the control rails 16, 18. In this it is not absolutely necessary for the control rail to be connected directly to the tongue rail 21. Rather, the adapter can possess the geometry of a section of the control rail in its track region and be joined, e.g. welded, by its end face to the control rail 16, 18 extending outside of the adapter.

Inside the holding device 24, the tongue rail end (region 22) and a section of the control rail 16, 18 should merge together in an oblique joint 25 of in particular 30°.

The adapter is embodied in a block-like manner and possesses a channel-like recess 26, which extends along the longitudinal rail direction and into which the root-sided region 22 of the tongue rail 21 can be inserted. Next to the tongue rail section 22 a wedge element such as a wedge anchor plate 28 is subsequently inserted into the channel-like recess 26. The wedge anchor plate 28 is secured by means of one or preferably several bolts 30, which engage with a nut or a head 32 into a T-slot 34 in the adapter, which facilitates simple tightening and securing.

The holding device 24 or the adapter itself in this embodiment example rests upon the foot 36 of the stock rail 16 and is joined to the latter via support wedges 38 by in particular welding. The foot 36 in turn originates from a baseplate 40 and preferably is welded to the latter.

On both sides of the holding device 24, which as mentioned above can be referred to as adapter, extend ledge-like walls 42, 44 that are connected, e.g. welded, to the baseplate 40. Further, support elements may originate from the baseplate 40 on the exterior side, as is purely schematically illustrated by the support element 46 in FIG. 4.

The right end wall 42 shown in the illustration of FIG. 4 possesses in its head region a flat steel element 48, which extends along the direction of the tongue rail 21 or its root section 22 and serves in the function of a side rail. The flat steel element 48 is welded to the end wall 42.

The region of the adapter or holding device 24 is for the most part contained in a housing, which gives rise to assembly boxes 52, which are composed of the walls 42, 44 as side walls, the ledge 48 as well as a plate-shaped flat element 54 originating from the upper end face of the wall 44.

Figure 1:
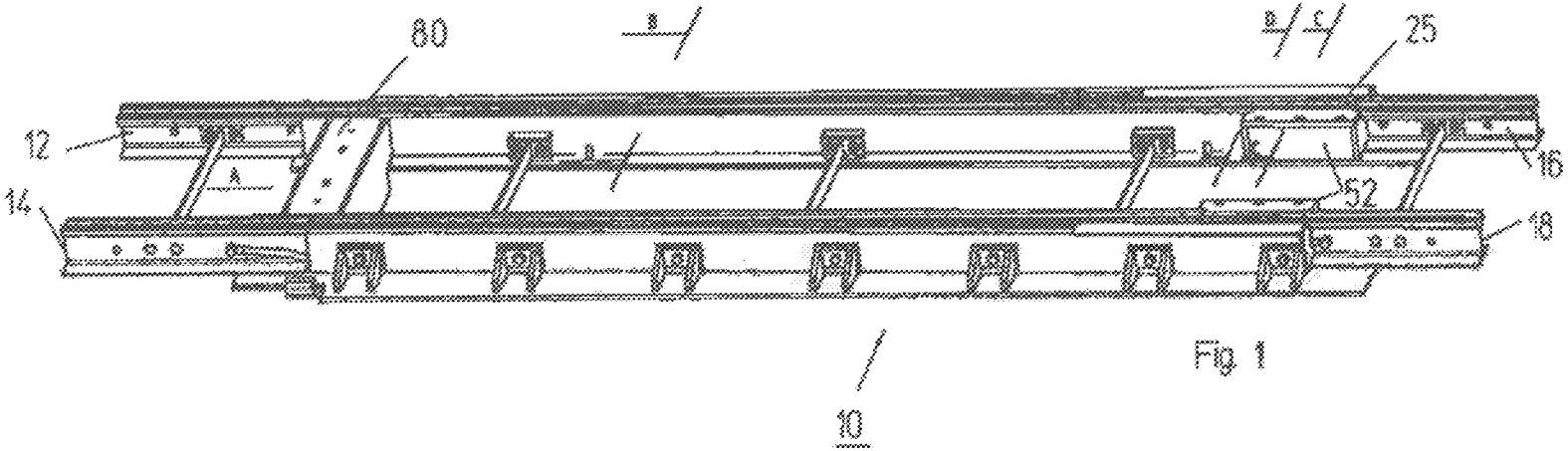
FIG. 1 shows a rail expansion device.

As is illustrated in FIG. 1, the elements 48, 54, which also can be referred to as ledge-like are also bolted or welded to the walls 42, 44.

Outside of the adapter or holding device 24, a side rail 50 extends along the rail expansion that may merge into the wall 42. In this, the side rail 50 originates from the baseplate 40.

Independent hereof, it is not necessary for the baseplate 40 to extend continuously from the start to the end of the rail expansion. Rather, several baseplate sections may be provided, which are separated by some distance and which are connected by the side rail 50 or the wall 42.

Within the holding device 24, the tongue rail 21 is supported by the bottom surface 56 of the channel-like recess 26. Wedging the tongue rail 21 results in both horizontal and vertical immobilization. Outside of the holding device 24, the tongue rail 21 is supported on a guide rail 58, which originates from the side rail 50. In this, the guide rail 58, which can also be referred to as slide plate, extends—with its longitudinal edge that extends on the side-rail side—into a geometrically matching groove- or slit-shaped receptacle 60 of the side rail 50. The guide rail 58 at the same time serves as lateral support of the stock rail 12, which on the outer side, i.e. the opposite side, is supported by a second guide in form of a vertically extending plate element 62. Consequently, the stock rail 12 is able to move along the longitudinal direction between the guide rail 58 and the guide plate 62, which also can be referred to as guide plate, i.e. is able to expand and contract. A horizontal immobilization is achieved by laterally restricting the stock rail 12 in between the guide rail 58 and the guide plate 62. A vertical movement is prevented by the fact that the stock rail 12 with a longitudinal foot edge region 64 engages into a geometrically matching cut-out 66 of the guide plate 62. In this, the recess or cut-out 64 is bordered by the baseplate 40 on the ground side.

The rail tongue 21 rests upon the guide rail 58. Horizontal immobilization or immobilization to a large extent is achieved by arranging spacer strips 72 between the outer side 68 extending on the side-rail side and the facing inner surface 70 of the side rail 50, whereby the spacer strips 72 preferably are detachably mounted to the guide rail 58 by means of screwed connections. Horizontal movement of the tongue rail 21 is ruled out by the feature that the tongue rail 21 undercuts the head 74 of the stock rail 12.

The illustration of FIG. 3 further shows that the guide rail 58 may be supported by plate-like support elements 76 that originate from the baseplate 40. Furthermore, the guide plate 62 is secured on the outer side via support elements 78.

Figure 5:
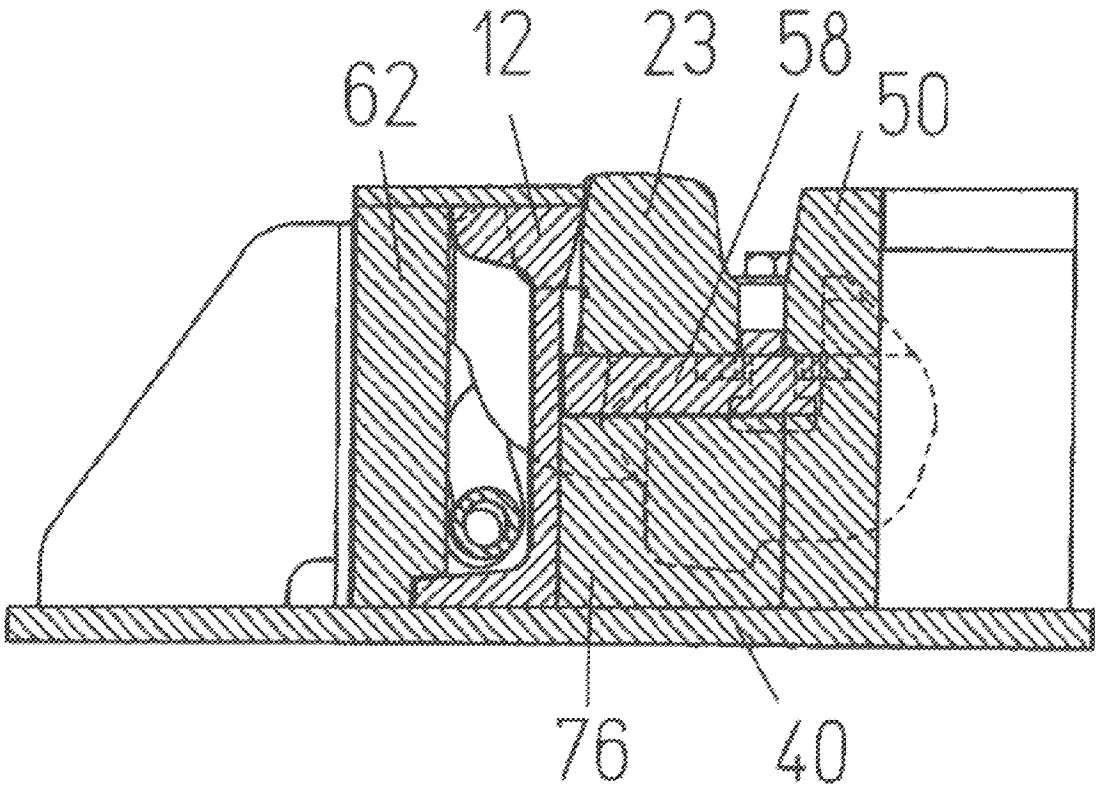
FIG. 5 shows a sectional view along the line D-D in FIG. 1.

FIG. 5 shows a sectional view along the line D-D of FIG. 1, which is situated in front of the holding device 24 or the assembly box 52. Discernable is the side rail 50, from which originates the guide rail 58, upon which rests a section 23 of the tongue rail 21. With the side of its web facing the tongue rail, the stock rail 12 is in contact with the guide rail 58. On the opposite side, the guide plate 62 extends along the longitudinal direction of the stock rail 12. Also illustrated is a plate element 76 that supports the guide rail 58.

Figure 2:
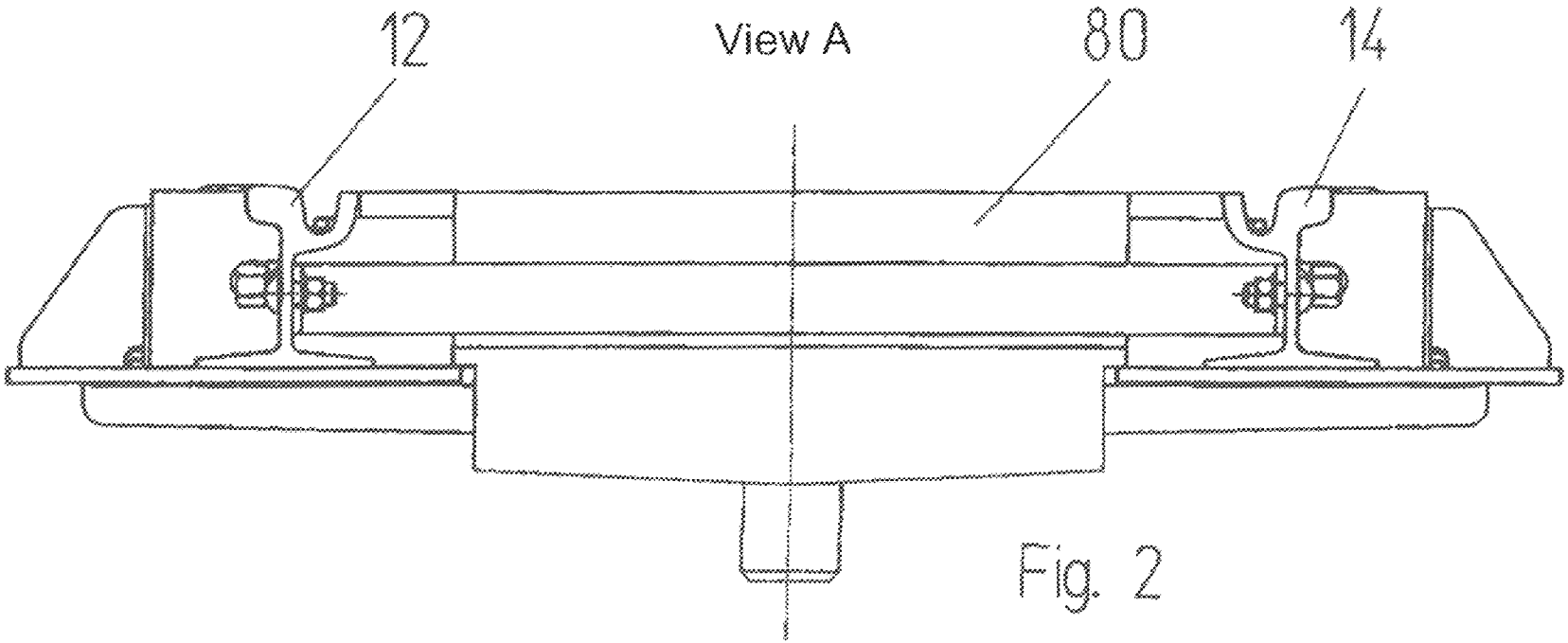
FIG. 2 shows a view along direction A of FIG. 1.

As shown in FIG. 2, a drainage box 80 is arranged at the end of the rail expansion device 10, i.e. in front of the tongue tip in the drawing. The drainage box 80 is connected to the interior spaces of the rail expansion device 10 that are contained between the stock rail 12 and the guide plate 62, and the side rail 50 and an exterior enclosure 80. There also exists a connection between the areas bordered by the support elements 76 and the above-described exterior chambers. In addition, a shorting connector 84—i.e. a power cable with large cross-section—extends immediately adjacent to the stock rail 12, i.e. in the exterior chamber bordered by the guide plate 62 and the stock rail 12. The shorting connector guarantees electrical conductivity between the stock rail 12 and the control rail 16.

The invention claimed is:

1. A rail expansion device (10) with stock rail and tongue rail (12, 20, 21, 22), which are longitudinally movable and are in contact under an application of force acting transversely relative to a longitudinal direction of the rail, characterized in that the tongue rail (20, 21, 22), at some distance from the tongue rail section that is in contact with the stock rail (12, 14), is detachably accommodated by a holding device (24), and that the tongue rail in the holding device is connected form-fittingly and force-fittingly to a control rail (16, 18) merging into the holding device, or to a section of the control rail, or to a section of the holding device (24) with a profile that merges into the control rail.

2. The rail expansion device of claim 1, characterized in that the stock rail (12, 14) is longitudinally displaceable relative to the tongue rail (21).

3. The rail expansion device of claim 1, characterized in that a region of the tongue rail (21) that is in contact with the stock rail (12, 14) rests upon a support (58), which also is the inner guide acting as a first guide for the stock rail (12, 14).

4. The rail expansion device of claim 3, characterized in that the stock rail (12, 14) that is longitudinally moveable relative to the tongue rail (20, 21, 22) is supported on a baseplate (40), that a side rail (50) originates from the baseplate (40), and that the first guide is connected to the side rail.

5. The rail expansion device of claim 3, characterized in that the first guide (58) is a ledge, which is supported by support elements (76) originating in the baseplate (40).

6. The rail expansion device of claim 1, characterized in that an outer side of the stock rail (12), at least in sections, is in contact with an outer guide acting as a second guide.

7. The rail expansion device of claim 6 characterized in that the stock rail (12, 14) with a longitudinal edge region (64) of a foot of the stock rail engages into a longitudinal cut-out (66) in the second guide (62) that is bordered on the ground-side by a baseplate (40).

8. The rail expansion device of claim 6, characterized in that between the stock rail (12) and the guide plate (62) forming the second guide extends an inner chamber, in which is arranged a shorting connector (84).

9. The rail expansion device of claim 1, characterized in that the first guide (58) with a longitudinal edge of the first guide facing away from the stock rail engages into a geometrically matching longitudinal recess, such as a longitudinal slot, of the side rail (50).

10. The rail expansion device of claim 1, characterized in that in between the outer surface (68) of the tongue rail (20, 21, 22) facing away from the stock rail and the inner surface (70) of the side rail (50) is arranged at least one spacer element (72) that prevents a horizontal movement of the tongue rail.

11. The rail expansion device of claim 1, characterized in that the spacer element (72) is detachably connected to the first guide (58).

12. The rail expansion device of claim 1, characterized in that the holding device (24) possesses a block-shaped geometry with a channel-like recess (26), which extends along the longitudinal rail direction and in which the tongue rail (21), preferably in an oblique joint (25) of in particular 30° relative to the rail longitudinal axis, merges into the control or connecting rail (16, 18) or into a section connected with the connecting rail.

13. The rail expansion device of claim 1, characterized in that in the holding device (24) extends a second channel-like recess along the rail longitudinal direction, preferably in form of a T-slot (34), into which engages a fastening element for a wedge element (28), by means of which the tongue rail or a root of the tongue rail end can be secured in the holding device to be form-fittingly and force-fittingly connected to the control rail or a section of the control rail.

14. The rail expansion device of claim 1, characterized in that the holding device (24) is connected to a bottom plate (36) via wedge elements (38), which in turn are connected to the baseplate (40).

15. The rail expansion device of claim 1, characterized in that the rail expansion device (10) preferably is contained in the housing over an entire length of the housing and that existing chambers or spaces are connected by a drainage box (80) extending outside of the rail tongue.

16. The rail expansion device of claim 1, characterized in that at some distance from a section of the tongue rail that is in contact with the stock rail (12, 14), the tongue rail (20, 21, 22) is contained detachably in a holding device (24), that inside the holding device the tongue rail is form-fittingly and force-fittingly connected to a control rail (16, 18) merging into the holding device, or to a section of the control rail, or to a section of the holding device (24) with a profile that merges into the control rail, that the stock rail is longitudinally moveable relative to the tongue rail, that the tongue rail in a section of the tongue rail that is in contact with the stock rail rests upon a support (58), which is the inner guide, acting as a first guide for the stock rail (12), and that the stock rail (12) on the outer side at least in sections is in contact with an outer guide, such as a guide plate (62), acting as a second guide.

17. The rail expansion device of claim 1, characterized in that the tongue rail (21) consists of a highly wear-resistant steel, hard manganese steel, tempered rail steel (R 350 HT), tempered close-grained structural steel, in grades 400 to 500.

18. The rail expansion device of claim 1, characterized in that the holding device (24) is supported upon the foot (36) of the control rail (16, 18).

* * * * *